US008490446B2

(12) United States Patent
Rao et al.

(10) Patent No.: US 8,490,446 B2
(45) Date of Patent: Jul. 23, 2013

(54) PROGRAMMABLE LOCK CYLINDER ASSEMBLY

(75) Inventors: Ajeya S. Rao, Mangalore (IN); Mahesh Vithalrao Grampurohit, Hubli (IN)

(73) Assignee: Schlage Lock Company, Carmel, IN (US)

( * ) Notice: Subject to any disclaimer, the term of this patent is extended or adjusted under 35 U.S.C. 154(b) by 111 days.

(21) Appl. No.: 13/085,742

(22) Filed: Apr. 13, 2011

(65) Prior Publication Data

US 2011/0259065 A1 Oct. 27, 2011

Related U.S. Application Data

(60) Provisional application No. 61/327,263, filed on Apr. 23, 2010.

(51) Int. Cl.
*E05B 25/00* (2006.01)

(52) U.S. Cl.
USPC ..... 70/383; 70/338; 70/492; 70/495

(58) Field of Classification Search
USPC ..... 70/337–343, 368, 492–496, 382–385
See application file for complete search history.

(56) References Cited

U.S. PATENT DOCUMENTS

| | | | |
|---|---|---|---|
| 1,494,765 | A | 5/1924 | Barrett |
| 1,514,318 | A | 5/1924 | Henriksson |
| 1,564,556 | A | 12/1925 | Goodfellow |
| 1,965,336 | A | 7/1934 | Gerald |
| 3,320,781 | A | 5/1967 | Hill |
| 3,499,302 | A | 3/1970 | Spain |
| 3,589,153 | A | 6/1971 | Hill |

(Continued)

FOREIGN PATENT DOCUMENTS

| | | |
|---|---|---|
| EP | 0226252 | 6/1987 |
| EP | 1752601 | 2/2007 |

(Continued)

OTHER PUBLICATIONS

International Search Report for PCT/US2008/007392 dated Mar. 12, 2009.

(Continued)

*Primary Examiner* — Suzanne Barrett
(74) *Attorney, Agent, or Firm* — RatnerPrestia

(57) ABSTRACT

A programmable lock cylinder assembly including a lock housing and a cylinder plug including a keyway extending therein. At least one locking member is moveable in the cylinder plug between a locked position wherein the cylinder plug is rotationally locked relative to the housing and an unlocked position wherein the cylinder plug is rotational relative to the housing. A plurality of pin sets are positioned in the cylinder plug. Each pin set includes a keyway pin component and a locking pin component and is positioned such that a portion of each keyway pin component extends across the keyway. The pin components are selectively engagable. A re-combinating member is engaged with one of the components of each pin set and is moveable between a first position wherein the keyway pin components are engaged with the locking pin components and a second position wherein the keyway pin components are disengaged from the locking pin components. A reset actuator is moveable between an engaged position wherein the re-combinating member position is locked relative to the cylinder plug and a non-engaged position wherein the re-combinating member position is moveable relative to the cylinder plug.

13 Claims, 12 Drawing Sheets

U.S. PATENT DOCUMENTS

| | | | | |
|---|---|---|---|---|
| 3,983,728 | A | 10/1976 | Phillips | |
| 3,991,596 | A | 11/1976 | Gartner | |
| 3,999,413 | A | 12/1976 | Raymond | |
| 4,122,694 | A | 10/1978 | Gretler | |
| 4,142,389 | A | 3/1979 | Bahry | |
| 4,231,242 | A | 11/1980 | Hill | |
| 4,290,287 | A | 9/1981 | Peppard | |
| 4,376,382 | A | 3/1983 | Raymond | |
| 4,377,082 | A | 3/1983 | Wolter | |
| 4,453,432 | A | 6/1984 | Widen | |
| 4,712,399 | A | 12/1987 | Mattossovich | |
| 4,741,188 | A | 5/1988 | Smith | |
| 4,836,002 | A | 6/1989 | Monahan | |
| 4,966,021 | A | 10/1990 | Boag | |
| 5,325,690 | A | 7/1994 | Adler | |
| 5,495,733 | A | 3/1996 | Yen | |
| 5,502,990 | A | 4/1996 | Hirvi | |
| 5,718,136 | A | 2/1998 | Aldieri | |
| 6,076,386 | A | 6/2000 | Etchells | |
| 6,119,495 | A | 9/2000 | Loreti | |
| 6,477,876 | B1 | 11/2002 | Kim | |
| 6,578,396 | B2 | 6/2003 | Field | |
| 6,681,609 | B1 | 1/2004 | Preddey | |
| 6,860,131 | B2 | 3/2005 | Armstrong | |
| 6,862,909 | B2 | 3/2005 | Armstrong | |
| 6,871,520 | B2 | 3/2005 | Armstrong | |
| 6,935,146 | B1 | 8/2005 | Lin | |
| 6,959,569 | B2 | 11/2005 | Strader | |
| 6,973,813 | B2 | 12/2005 | Erdely | |
| 6,983,630 | B2 | 1/2006 | Eden, Jr. et al. | |
| 7,007,528 | B2 | 3/2006 | Chong | |
| 7,028,517 | B2 | 4/2006 | Divito | |
| 7,114,357 | B2 | 10/2006 | Armstrong | |
| 7,117,701 | B2 | 10/2006 | Armstrong | |
| 7,162,900 | B1 | 1/2007 | Lu | |
| 7,162,901 | B2 | 1/2007 | Williams | |
| 7,181,937 | B2 | 2/2007 | Keller | |
| 7,181,938 | B2 | 2/2007 | Price | |
| 7,207,200 | B2 | 4/2007 | Eden, Jr. et al. | |
| 7,213,429 | B2 | 5/2007 | Armstrong | |
| 7,225,651 | B2 | 6/2007 | Edwards | |
| 7,234,331 | B2 | 6/2007 | Armstrong | |
| 7,240,523 | B2 | 7/2007 | Johansson | |
| 7,240,525 | B2 | 7/2007 | SevillanoGil | |
| 7,290,418 | B2 | 11/2007 | Herdman | |
| 7,308,811 | B2 | 12/2007 | Armstrong | |
| 7,322,219 | B2 | 1/2008 | Armstrong | |
| 7,340,929 | B1 | 3/2008 | Christopoulos | |
| 7,448,239 | B1 | 11/2008 | Huang | |
| 7,448,240 | B1 | 11/2008 | Huang | |
| 7,526,935 | B2 | 5/2009 | Huang | |
| 7,584,635 | B2 | 9/2009 | Gan | |
| 7,624,606 | B1 | 12/2009 | Huang | |
| 7,628,048 | B2 | 12/2009 | Huang | |
| 7,634,930 | B2 | 12/2009 | Boesel | |
| 7,836,739 | B2 * | 11/2010 | Huang et al. | 70/360 |
| 7,937,976 | B2 * | 5/2011 | Huang et al. | 70/338 |
| 7,980,104 | B1 * | 7/2011 | Huang | 70/338 |
| 7,980,106 | B2 * | 7/2011 | Huang et al. | 70/383 |
| 8,056,378 | B2 * | 11/2011 | Huang et al. | 70/338 |
| 8,117,876 | B2 * | 2/2012 | Mathachan | 70/492 |
| 8,161,783 | B2 * | 4/2012 | Huang et al. | 70/492 |
| 2005/0217330 | A1 | 10/2005 | Chong | |
| 2006/0059965 | A1 | 3/2006 | Benstead | |
| 2006/0112748 | A1 | 6/2006 | Benstead | |
| 2007/0017264 | A1 | 1/2007 | Seliber | |
| 2007/0028658 | A1 | 2/2007 | Widen | |
| 2007/0051147 | A1 | 3/2007 | Widen | |
| 2007/0062230 | A1 | 3/2007 | Preddey | |
| 2007/0089468 | A1 | 4/2007 | Chong | |
| 2007/0101782 | A1 | 5/2007 | Shen | |
| 2007/0186601 | A1 | 8/2007 | Lin | |
| 2007/0193317 | A1 | 8/2007 | Herdman | |
| 2007/0271976 | A1 | 11/2007 | Dalton | |
| 2007/0289346 | A1 | 12/2007 | Hyatt | |
| 2008/0011033 | A1 | 1/2008 | Chong | |
| 2008/0078224 | A1 | 4/2008 | Wheatland | |
| 2008/0092611 | A1 | 4/2008 | Armstrong | |
| 2008/0163657 | A1 | 7/2008 | Dickhans | |
| 2008/0276673 | A1 | 11/2008 | Huang et al. | |
| 2008/0314102 | A1 | 12/2008 | Gan | |
| 2009/0078012 | A1 | 3/2009 | Huang | |
| 2009/0277234 | A1 * | 11/2009 | Huang et al. | 70/357 |
| 2009/0277236 | A1 * | 11/2009 | Huang et al. | 70/368 |
| 2009/0277239 | A1 * | 11/2009 | Mathachan | 70/383 |
| 2009/0277240 | A1 * | 11/2009 | Huang et al. | 70/493 |
| 2010/0050717 | A1 * | 3/2010 | Chiang et al. | 70/377 |
| 2011/0041579 | A1 * | 2/2011 | Chen | 70/495 |
| 2011/0154872 | A1 * | 6/2011 | Huang et al. | 70/384 |
| 2011/0226027 | A1 * | 9/2011 | Huang et al. | 70/493 |

FOREIGN PATENT DOCUMENTS

| | | |
|---|---|---|
| WO | 9840589 | 9/1998 |
| WO | 2006010080 | 1/2006 |
| WO | 2006033864 | 3/2006 |
| WO | WO 2008/156664 A2 | 12/2008 |

OTHER PUBLICATIONS

Examination Report for New Zealand Patent Application No. 592460, dated May 3, 2011.

European Search Report for Application No. EP 11 25 0492 mailed Dec. 14, 2012.

* cited by examiner

PROGRAMMABLE LOCK CYLINDER ASSEMBLY

CROSS REFERENCE TO RELATED APPLICATIONS

This application claims priority to U.S. Patent Application No. 61/327,263, filed Apr. 23, 2010, the contents of such application being incorporated herein by reference.

BACKGROUND OF THE INVENTION

The present invention relates to lock cylinder assemblies. More particularly, the present invention relates to a lock cylinder assembly that may be reprogrammed without removing the cylinder plug.

When reprogramming a lock cylinder using a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the reprogramming process.

SUMMARY OF THE INVENTION

In at least one aspect, the present invention provides a programmable lock cylinder assembly including a lock housing and a cylinder plug including a keyway extending therein. At least one locking member is moveable in the cylinder plug between a locked position wherein the cylinder plug is rotationally locked relative to the housing and an unlocked position wherein the cylinder plug is rotational relative to the housing. A plurality of pin sets are positioned in the cylinder plug. Each pin set includes a keyway pin component and a locking pin component and is positioned such that a portion of each keyway pin component extends across the keyway. The pin components are selectively engagable. A re-combinating member is engaged with one of the components of each pin set and is moveable between a first position wherein the keyway pin components are engaged with the locking pin components and a second position wherein the keyway pin components are disengaged from the locking pin components. A reset actuator is moveable between an engaged position wherein the re-combinating member position is locked relative to the cylinder plug and a non-engaged position wherein the re-combinating member position is moveable relative to the cylinder plug.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

Figure 1:
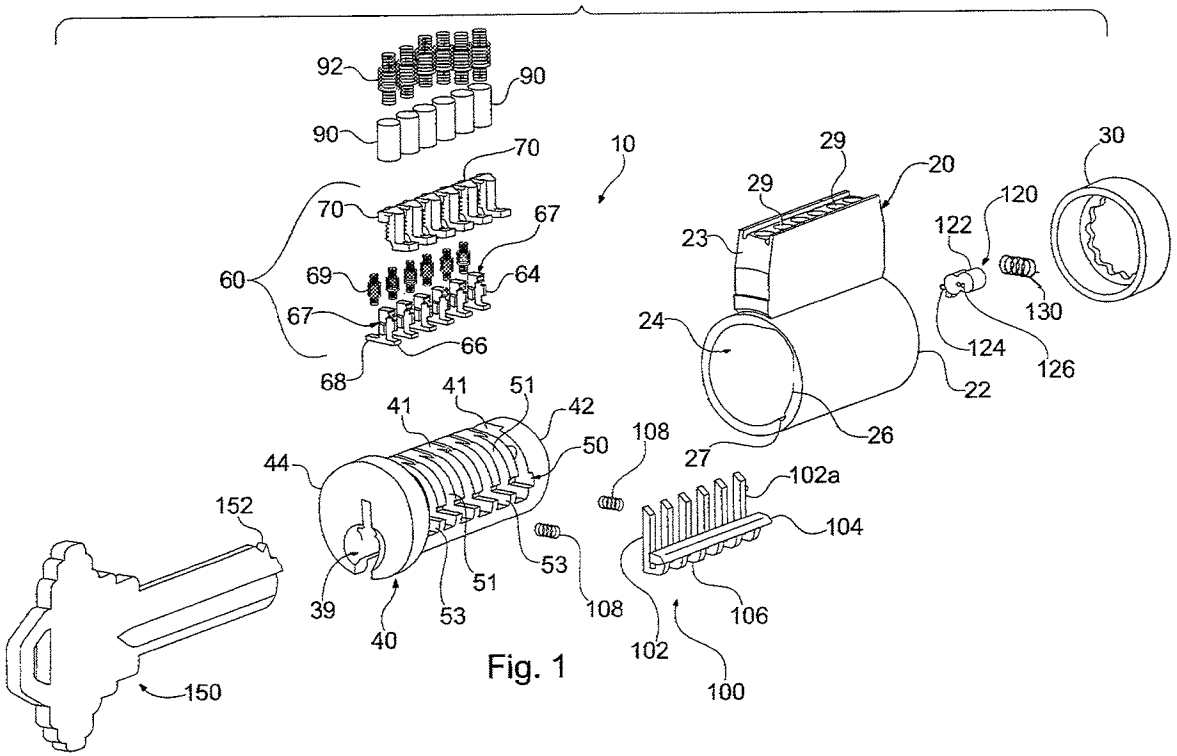
FIG. 1 is an exploded isometric view of a programmable lock cylinder assembly according to a first embodiment of the invention.
Figure 3:
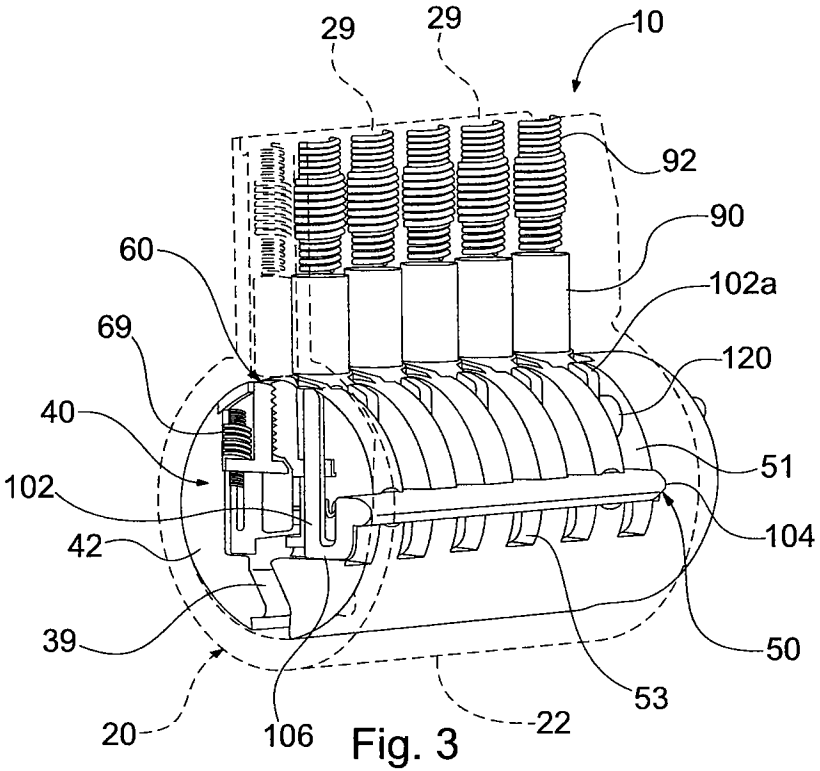
FIG. 3 is an isometric view of the programmable lock cylinder assembly of FIG. 1 with housing shown translucently.
Figure 2:
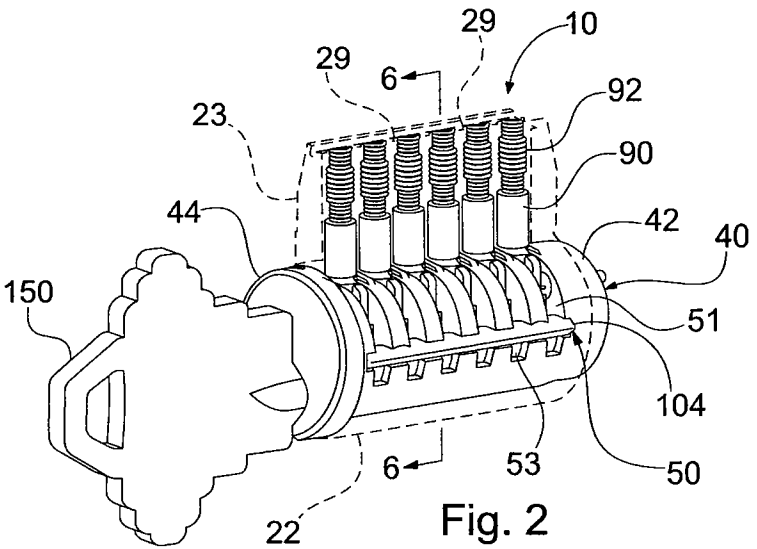
FIG. 2 is an assembled isometric view of the programmable lock cylinder assembly of FIG. 1 with a key inserted therein with the housing shown in partial cross-section.

A programmable lock cylinder assembly 10 in accordance with a first embodiment of the invention is illustrated and described with reference to FIGS. 1-10. Referring to FIGS. 1-3, the programmable lock assembly 10 generally comprises a lock housing 20 and a cylinder plug 40. The lock housing 20 includes a body 22 defining a generally tubular opening 24 extending the length thereof. The tubular opening 24 is configured to receive the cylindrical body 42 of the cylinder plug 40 and may include a shoulder 26 about the opening 24 which engages a flange 44 on one end of the cylinder plug 40. Referring to FIG. 2, the cylinder plug 40 preferably extends out the opposite end of the housing 20 and is configured for connection to an output mechanism (not shown) for transmitting force from the cylinder plug 40 to one or more elements connected to the lock cylinder assembly 10. The output mechanism can take a number of different forms, including without limitation, a lever, drive shaft, coupling, cam, or other element mounted to the lock cylinder assembly 10. The present lock cylinder assembly may be utilized in any desired application. In the illustrated embodiment, a retaining ring 30 engages the cylinder body 42 to retain the lock cylinder assembly 10 in the assembled state illustrated in FIG. 2.

Referring to FIGS. 1-3 and 6, the housing body 22 includes a tapered groove 27 extending along the inside surface of the opening 24. The tapered groove 27 facilitates reprogramming of the lock cylinder assembly 10, as described in more detail hereinafter. The housing body 22 further includes a radially extending tower 23 with a plurality of through bores 29 which align with split pin bores 41 of the cylinder plug 40 when the cylinder plug 40 is positioned in a home position. The through bores 29 are configured to receive top pins 90 and top springs 92. In the home position, each top spring 92 urges a respective top pin 90 into the aligned split pin bore 41, with the top pins 90 extending across the shear line between the cylinder plug 40 and the housing 20 to maintain the cylinder plug 40 rotationally locked relative to the housing 20 unless a proper key is positioned in the keyway 39 of the cylinder plug 40. A cover or the like (not shown) may be positioned over the through bores 29 to retain the top pins 90 and top springs 92 in the through bores 29.

The split pin bores 41 extend substantially perpendicular to the central axis of the cylinder plug 40. Each split pin bore 41 is configured to receive and guide the axial movement of a split pin 60. A plurality of keyway spring bores 25, see FIG. 6, extend into the cylinder plug 40 parallel to the split pin bores 41. Each keyway spring bore 25 houses a keyway spring 69 that biases a respective split pin 60 inwardly in its split pin bore 41. The keyway spring bores 25 may be formed integrally with the rack pin bores 41.

Figure 4:
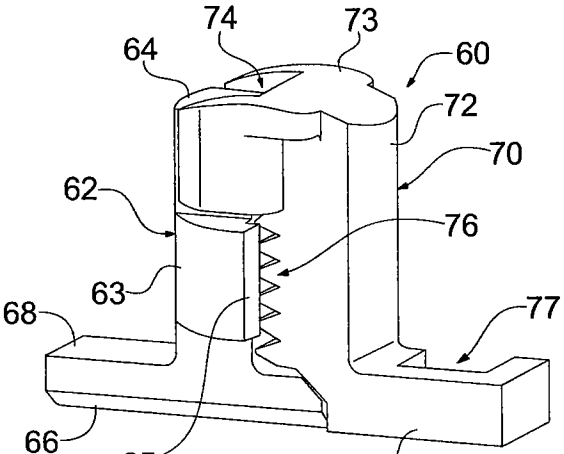
FIG. 4 is an isometric view of a split pin in accordance with a first embodiment of the invention.
Figure 6:
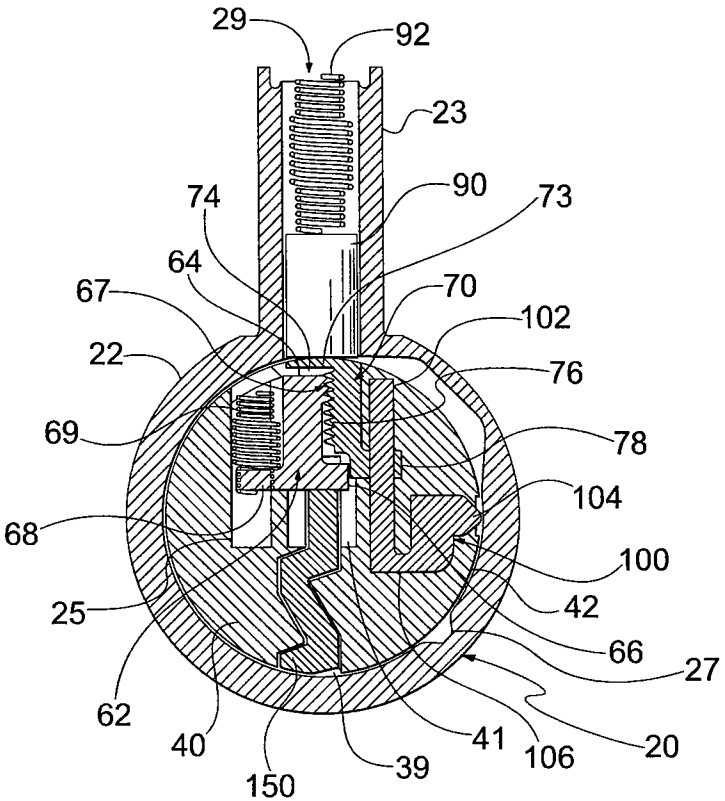
FIG. 6 is a cross-sectional view along line 6-6 in FIG. 2 with a user key inserted and the lock cylinder assembly in a home position.

Referring to FIGS. 1, 4 and 6, each split pin 60 includes a keyway portion 62 (keyway pin component) and a top pin portion 70 (locking pin component). The keyway portion 62 includes a vertical body 64 with a transverse member 66 extending along one end thereof. The transverse member 66 is positioned to extend across the keyway 39 and engage the teeth of a key inserted in the keyway 39. The transverse member 66 defines a shoulder 68 which is engaged by the keyway spring 69, thereby biasing the keyway portion 62, and top pin portion 70 when engaged, inwardly in the split pin bore 41. While the shoulder 68 of the present embodiment is a portion of the transverse member 66, it may otherwise be provided along the keyway portion 62. Additionally, the vertical body 64 may be formed such that the transverse member 66 is not required. A face 65 of the keyway portion 62 includes one or more teeth 67, see FIG. 1, configured to engage a ratchet surface 76 of the top pin portion 70 as will be described. The vertical body 64 may include a flared area 63 which is configured to engage a portion of the top pin portion 70 and define a stop therefore.

Each top pin portion 70 includes a vertical body 72 with a head 73 configured to engage a respective top pin 90 and also to configure the flared area and thereby limit the inward movement of the top pin portion 70 relative to the keyway portion 62. The head 73 defines a notched portion 74 configured to receive a portion of the keyway portion body 64 and thereby guide relative movement between the portions 62 and 70 as described hereinafter. As explained above, each top pin portion 70 includes a ratchet surface 76 with a plurality of ratchet teeth configured to engage the one or more teeth 67 of the keyway portion 62 to define the relative radial position of the portions 62 and 70 when they are engaged with one another. A leg 78 extends from the vertical body 72 and defines an alignment notch 77 configured to receive a portion of the re-combinating sidebar 100.

When the top pin portion 70 is engaged with a corresponding keyway portion 62, the spring 69 biases the split pin 60 toward the locked position wherein the corresponding top pin 90, which is supported by the head 73 of the top pin portion 70, extends into the split pin bore 41 across the shear line between the cylinder plug 40 and the housing 20 to maintain the cylinder plug 40 rotationally locked relative to the housing 20 unless a proper key is positioned in the keyway 39 of the cylinder plug 40.

In the present embodiment, the re-combinating sidebar 100 is utilized to control the selective engagement between the teeth 67 and the ratchet surface 76, as described in more detail below. Referring to FIGS. 1-3 and 6, the re-combinating sidebar 100 includes a plurality of shaft portions 102, each configured to be received in a respective alignment notch 77 of a corresponding top pin portion 70. A tapered bar 104 extends perpendicular from the shaft portions 102 and is connected thereto by bridging members 106. The cylinder body 42 includes a plurality of vertical slots 51, each configured to receive a corresponding shaft portion 102 with a top pin portion 70 engaged therewith. Each vertical slot 51 terminates in a horizontal slot 53 configured to receive a corresponding bridging member 106 and thereby guide radial movement of the re-combinating sidebar 100. A horizontal opening 50 extends through the side of the cylinder body 42 and is in communication with the vertical slots 51 such that the tapered bar 104 may extend radially outwardly from the cylinder plug 40. A plurality of springs 108 or the like are positioned between the cylinder body 42 and the tapered bar 104 such that the re-combinating sidebar 100 is biased radially outward.

Figure 5:
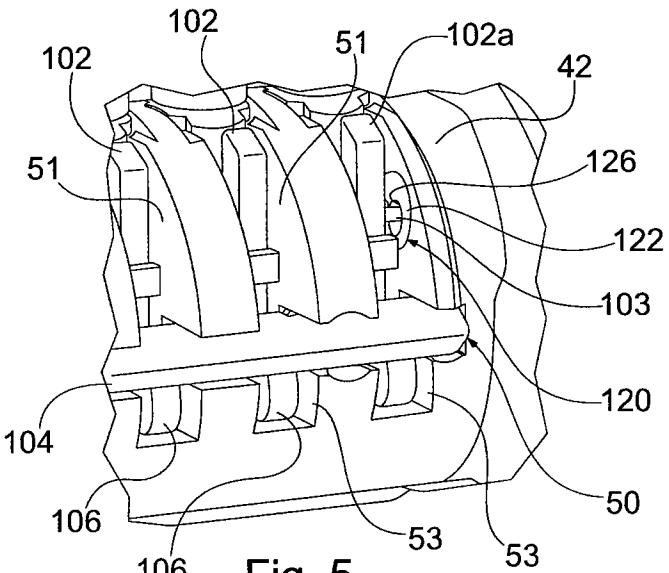
FIG. 5 is a partial right-side isometric view of the lock cylinder plug with the re-combinating sidebar engaging the reset actuator.

Referring to FIG. 6, during normal operation, the re-combinating sidebar 100 is maintained in a radially inward position such that the teeth 67 of the keyway portion 62 remains engaged with the intended teeth of the ratchet area 76 of the top pin portion 70. With reference to FIGS. 1, 5, 8 and 10, a reset actuator 120 is engagable between the cylinder body 42 and the re-combinating sidebar 100 to maintain the re-combinating sidebar 100 in this radially inward, normal operation mode. The reset actuator 120 includes an actuator body 122 with a reset contact 124 defined thereon (see FIG. 8). A front face of the actuator body 122 includes a bore 126. The bore 126 is configured to receive a post 103 extending rearward from rearward most shaft portion 102*a* (see FIG. 5). In the normal operating mode, the post 103 is received in bore 126, as shown in FIG. 5, and thereby maintains the re-combinating sidebar 100 in the radially inward, normal operating position. A spring 130 or the like engages the rear side of the actuator body 122 and biases the reset actuator 120 toward the re-combinating sidebar 100, thereby maintaining the post 103 engaged within the bore 126 unless a proper reset key 150' is positioned in the keyway 39.

Figure 8:
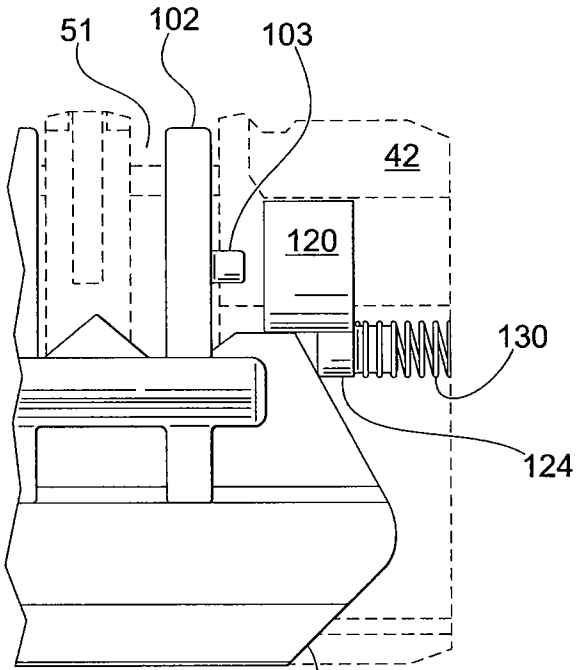
FIG. 8 is a partial cross-sectional view illustrating the engagement of a reset key with the reset actuator.
Figure 7:
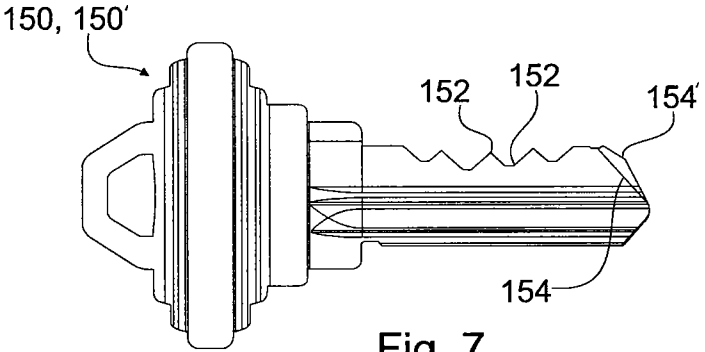
FIG. 7 is a side elevational view of a key illustrating both a user key configuration and a reset key configuration.

Referring to FIGS. 7 and 8, the present embodiment of the invention utilizes two distinct types of keys, namely a user key 150 and a reset key 150'. Both keys 150, 150' include a plurality of teeth and notches 152, but the reset key 150' includes a protruding tip 154' compared to the tapered tip 154 of the user key 150. During normal operation, a user inserts a user key 150 and the tapered tip 154 remains clear of the actuator reset contact 124. The actuator 120 remains biased by the spring 130 toward the re-combinating sidebar 100, thereby maintaining the post 103 engaged within the bore 126. As such, the re-combinating sidebar 100 is maintained in the inward position and the teeth 67 of the keyway portion 62 remains engaged with the intended teeth of the ratchet area 76 of the top pin portion 70. A user can insert a proper user key 150 which will engage the keyway portions 62 which in turn will move the top pin portions 70 axially such that the head 73 of each top pin portion 70 moves a respective top pin 90 until the junction of the head 73 and the top pin 90 is along the shear line. The lock cylinder assembly 10 may be utilized in a normal manner of a pinned lock cylinder assembly.

If a user desires to reprogram the lock cylinder assembly 10 without disassembling the lock cylinder assembly, the user may insert a proper reset key 150'. Insertion of the reset key 150' will cause the protruding tip 154' to engage the actuator reset contact 124 and thereby disengage the post 103 from the bore 126 as illustrated in FIG. 8. As explained below, reprogramming of the lock cylinder assembly 10 requires rotation of the cylinder plug 40. As such, inserting an improper key, even if such engages the actuator reset contact 124, will not allow reprogramming because the improper key will not properly move the split pins 60 and the cylinder plug 40 will not be rotatable.

Figure 10:
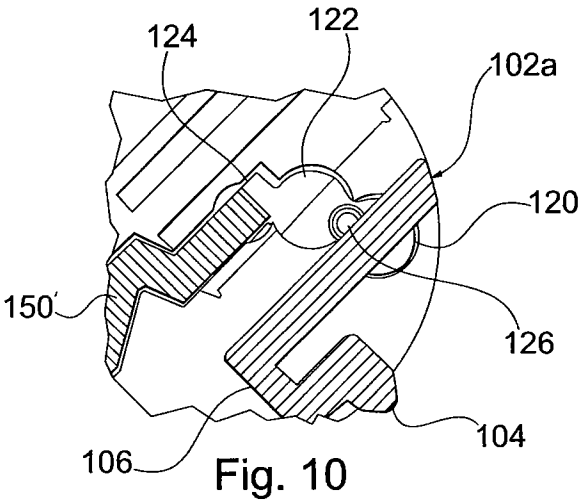
FIG. 10 is an enlarged view of a portion of FIG. 9 illustrating the re-combinating sidebar alignment relative to the reset actuator in the reset position.

Having generally described the components of the lock cylinder assembly 10, reprogramming thereof will now be described with reference to FIGS. 8-10. To reprogram the lock cylinder assembly 10, the user inserts a current reset key 150A' into the keyway. By "current", it is meant that the reset key 150A' has a tooth and notch 152 configuration which matches the currently programmed configuration of the lock cylinder assembly 10. When the current reset key 150A' is inserted, the key 150A' engages each of the keyway portions 62 and moves the respective top pin portions 70 to the unlock position wherein the junction of each head 73 and top pin 90 is along the shear line. The protruding tip 154' of current reset key 150A' also engages the actuator reset contact 124 and thereby disengages the reset actuator 120 from the post 103. Even though the reset actuator 120 is disengaged, the re-combinating sidebar 100 remains inward, and the teeth 67 of the keyway portion 62 remain engaged with the intended teeth of the ratchet area 76 of the top pin portion 70, because the tapered bar 104 is in contact with the inside surface of the housing opening 24.

Figure 9:
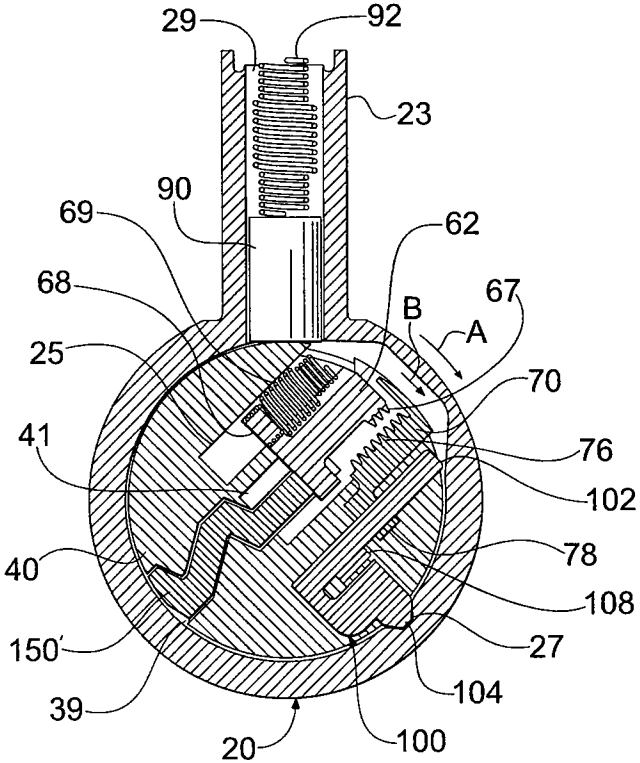
FIG. 9 is a cross-sectional view similar to FIG. 6 with the reset key inserted into the lock cylinder assembly and the cylinder plug rotated to a reset position.

The current reset key 150A' is then rotated in the direction of arrow A in FIG. 9. While clockwise rotation is illustrated in the present embodiment, the invention is not limited to such. For example, the tapered groove 27 may be positioned in the upper right quadrant of the housing body 22, in which case the plug cylinder 40 would be rotated counter-clockwise for reprogramming, or in any other desired position. Rotation of the key and cylinder plug 40 in the direction of arrow A is continued until the tapered bar 104 is aligned with the tapered groove 27 in the housing 20. The springs 108 bias the re-combinating sidebar 100 radially outward as the tapered bar 104 enters the tapered groove 27. As the re-combinating sidebar 100 moves radially outward, each top pin portion 70 is also moved in the direction of arrow B in FIG. 9 such that the teeth of the ratchet area 76 disengage from the teeth 67.

After rotation to the reset position is complete, the current reset key 150A' is removed whereby the keyway springs 69 bias the keyway portions to a lower most position. Additionally, when the current reset key 150A' is removed, the actuator reset contact 124 is no longer engaged and the spring 130 biases the reset actuator 120 toward the re-combinating sidebar 100. With the re-combinating sidebar 100 in the outward reprogram position, the post 103 engages in an outer bore (see FIG. 10, bore not shown), thereby locking the re-combinating sidebar 100 in such outward reprogram position. This prevents a user from insert a regular user key (non-reset key) and trying to return the cylinder plug 40 to the home position. Additionally, because the vertical body 72 of each top pin portion 70 does not completely align with the split pin bore 41, the top pin portions 70 remain in their radial position, with the heads 73 aligned with the shear line, when the key is removed.

To complete the reprogramming, it is necessary for the user to insert a new reset key 150B'. By "new", it is meant that the reset key 150B' has a tooth and notch 152 configuration which matches the configuration of the intended or new user key to which the lock cylinder assembly 10 is to be programmed. When the new reset key 150B' is inserted, each of the keyway portions 62 is moved to a desired position relative to a respective top pin portion 70. Additionally, the protruding tip 154' of the new reset key 150B' engages the actuator reset contact 124 and disengages the reset actuator 120.

The new reset key 150B' is rotated in the reverse direction which causes the tapered bar 104 to ride up the tapered groove 27 and move the re-combinating sidebar 100 radially inward. As the re-combinating sidebar 100 moves radially inward, the top pin portions 70 move radially inward toward the keyway portions 62, thereby engaging the teeth 67 with the corresponding teeth of the ratchet area 76 based on new reset key 150B' tooth and notch 152 configuration.

Once the cylinder plug 40 is returned to the home position, the key 150B' is removed. Upon removal, the reset actuator 120 is biased toward the re-combinating sidebar 100 such that post 103 is received in bore 126, thereby locking the re-combinating sidebar 100 and the associated top pin portions 70 in position. The reprogrammed lock cylinder assembly 10 may thereafter be operated in a normal manner with user keys 150 having the new configuration.

Figure 11:
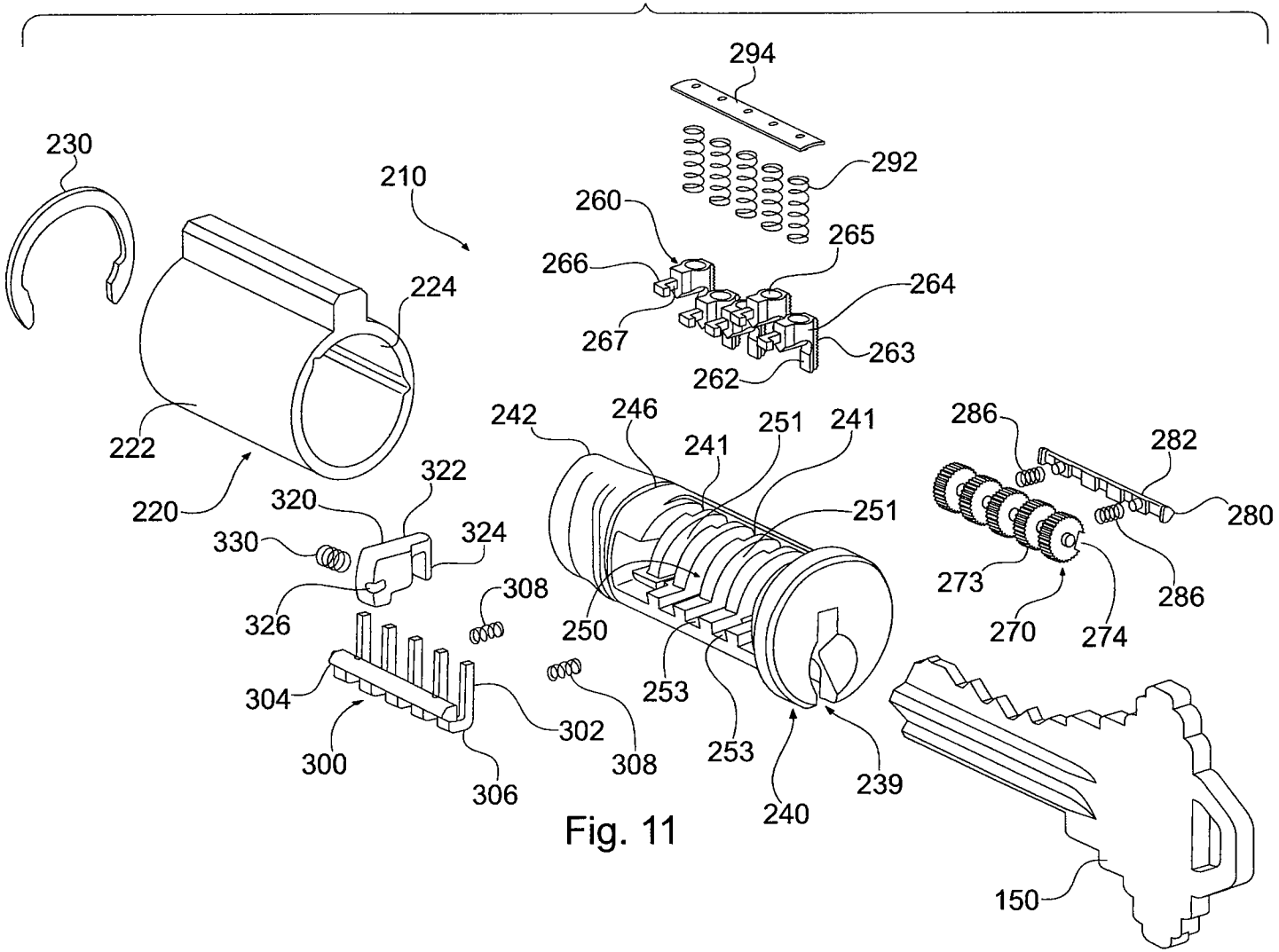
FIG. 11 is an exploded isometric view of a programmable lock cylinder assembly according to another embodiment of the invention.
Figure 13:
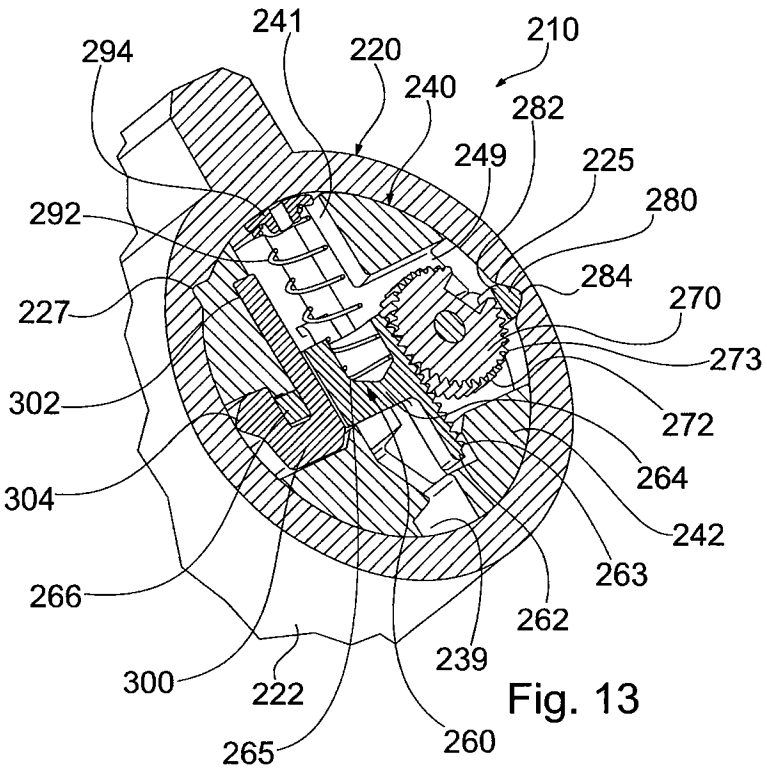
FIG. 13 is a cross-sectional isometric view of the lock cylinder assembly of FIG. 11 in a home position.
Figure 12:
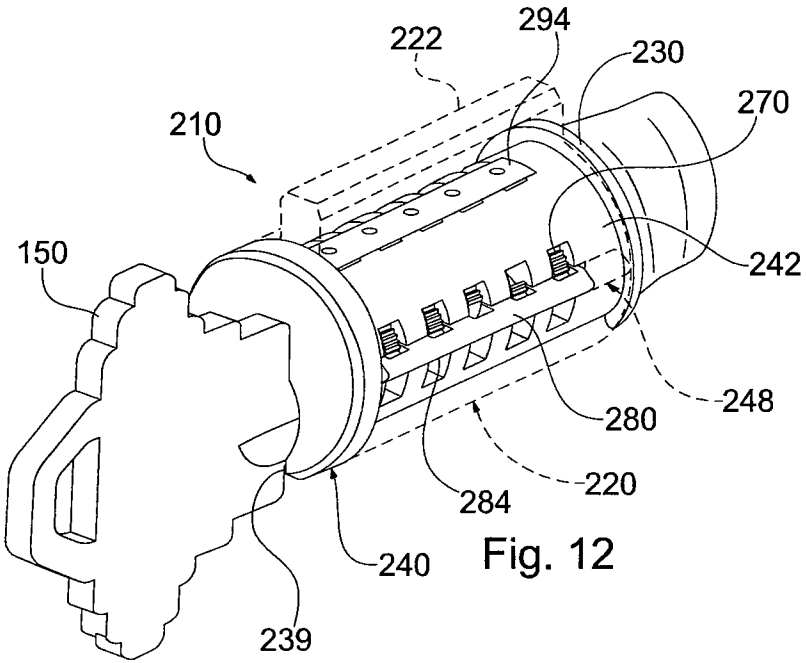
FIG. 12 is an assembled isometric view of the programmable lock cylinder assembly of FIG. 11 with a key inserted therein and the housing shown translucently.

A programmable lock cylinder assembly 210 in accordance with a second embodiment of the invention is illustrated and described with reference to FIGS. 11-19. Referring to FIGS. 11-13, the programmable lock assembly 210 generally comprises a lock housing 220 and a cylinder plug 240. The lock housing 220 includes a body 222 defining a generally tubular opening 224 extending the length thereof. The tubular opening 224 is configured to receive the cylindrical body 242 of the cylinder plug. Referring to FIG. 12, the cylinder plug 240 preferably extends out the opposite end of the housing 220 and is configured for connection to an output mechanism (not shown) for transmitting force from the cylinder plug 240 to one or more elements connected to the lock cylinder assembly 210. The output mechanism can take a number of different forms, including without limitation, a lever, drive shaft, coupling, cam, or other element mounted to the lock cylinder assembly 210. The present lock cylinder assembly may be utilized in any desired application. In the illustrated embodiment, a snap ring 230 engages a groove 246 in the cylinder body 242 to retain the lock cylinder assembly 210 in the assembled state illustrated in FIG. 12.

Referring to FIGS. 11 and 13, the housing body 222 includes a pair of tapered grooves 225 and 227 extending along the inside surface of the opening 224. A sidebar 280 extends from the cylinder plug 240 and engages the tapered groove 225 to maintain the cylinder plug 240 rotationally locked relative to the housing 220 unless a proper key is positioned in the keyway 239 of the cylinder plug 240. The tapered groove 227 facilitates reprogramming of the lock cylinder assembly 210, as described in more detail hereinafter.

Continuing with FIGS. 11 and 13, keyway pin bores 241 extend substantially perpendicular to the central axis of the cylinder plug 240. Each keyway pin bore 241 is configured to receive and guide the axial movement of a keyway pin 260, as described hereinafter. Each keyway pin bore 241 extends to the cylinder keyway 239 such that a key 150 inserted in the keyway 239 engages the keyway pins 260.

Referring to FIGS. 11 and 13, each keyway pin 260 (keyway pin component) has a vertical body 262 with a plurality of teeth 263 extending therealong. The teeth 263 are configured to engage gear teeth 273 of a corresponding gear 270 (locking pin component) as described hereinafter. A circular body portion 264 extends from the vertical body 262 opposite the teeth 263. A detent 265 is provided in each circular body portion 264 and is configured to receive a spring 292 or the like extending between a top cover 294 and the respective keyway pin 260 to bias the keyway pin 260 inward. A leg 266 with a sidebar notch 267 extends from the circular body portion 264. The notch 267 is configured to engage a portion of the re-combinating sidebar 300, similar to the previous embodiment.

Referring to FIG. 12, a sidebar opening 248 extends through a side surface of the cylinder body 242. The sidebar opening 248 is sized to receive a sidebar 280 such that a tapered portion 284 of the sidebar 280 is radially extendable from the cylinder plug 240. In the home position illustrated in FIG. 13, the tapered portion 284 extends from the cylinder plug 240 and is engaged in the tapered groove 225 to rotationally lock the cylinder plug 240 relative to the housing 220. One or more springs 286 are positioned between the sidebar 280 and internal portions of the cylinder body 242 to bias the sidebar radially outward.

The sidebar 280 is prevented from being moved radially inward, and thereby unlocking the lock, by gears 270 unless a proper key is positioned in the keyway 239. Each gear 270 is rotationally supported in the cylinder in a respective gear slot 249. Each gear 270 has an outer surface 272 with a plurality of teeth 273 extending thereabout except for a sidebar notch 274 defined in the gear 270 and configured to receive the rail portion 282 of the sidebar 280. As illustrated in FIG. 13, each gear 270 has a home rotational orientation wherein the sidebar notch 274 is not aligned with the sidebar, such that the outer surface 272 of the gear 270 contacts the sidebar rail portion 282 and prevents radial movement of the sidebar 280.

Figure 14:
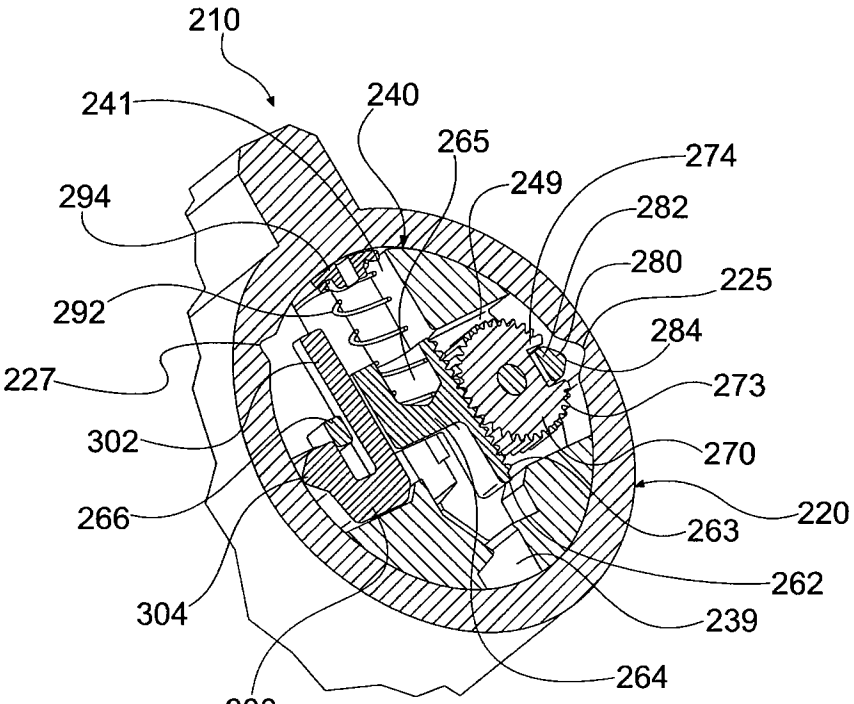
FIG. 14 is a cross-sectional isometric view similar to FIG. 13 with a user key inserted into the lock cylinder assembly.
Figure 15:
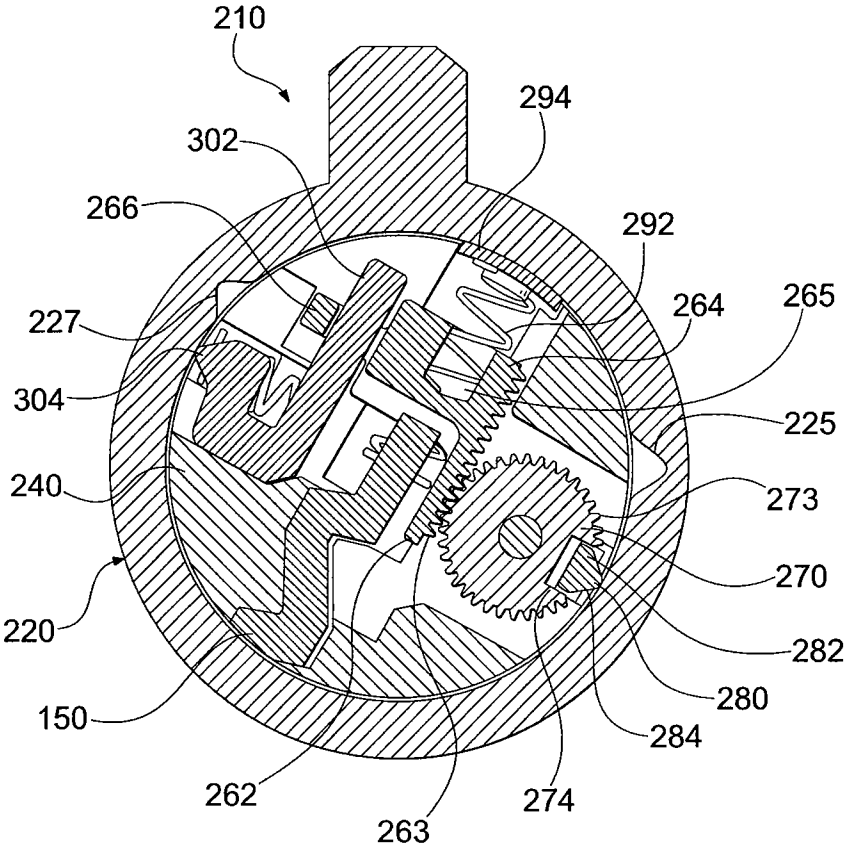
FIG. 15 is a cross-sectional view with a user key inserted into the lock cylinder assembly and the lock cylinder assembly rotated to an unlock position.

During normal operation, the gear teeth 273 engage the keyway pin teeth 263 such that axial movement of the keyway pin 260 causes rotation of the gear 270. In the home position illustrated in FIG. 13, the springs 292 bias the keyway pins 260 toward the locked position wherein the gears 270 are in the home position and the notches 274 are not aligned with the sidebar rail portion 282. When a proper key 150 is inserted in the keyway 239, the keyway pin 260 is moved axially which causes the gear 270 to rotate until the sidebar notch 274 is aligned with the sidebar rail portion 282 as shown in FIGS. 14 and 15. With each gear 270 so aligned, the sidebar 280 is movable radially inward. The sidebar 280 may be configured to automatically move radially inward, but, in the present embodiment, the sidebar 280 is biased radially outward as explained above.

Referring to FIGS. 14 and 15, with the proper key 150 inserted, the sidebar notches 274 are properly aligned, such that rotation of the key 150 causes the tapered portion 284 of the sidebar 280 to ride up the tapered groove 225 as the sidebar rail portion 282 is received in the notches 274. The lock cylinder assembly 210 is in an unlocked condition such that the cylinder plug 240 is rotatable relative to the housing 220. Rotation of the cylinder plug 240 actuates the output mechanism. When the key 150 is rotated back to the home position, the sidebar 280 automatically extends radially into engagement with the tapered groove 225. When the key 150 is removed, the gears 270 return to the home position wherein the notches 274 are no longer aligned with the sidebar rail portion 282 and the sidebar 280 is prevented from moving radially inward.

In the present embodiment, the re-combinating sidebar 300 is utilized to control the selective engagement between the gear teeth 273 and the ratchet teeth 263, as described in more detail below. Referring to FIGS. 11 and 13-16, the re-combinating sidebar 300 includes a plurality of shaft portions 302, each configured to be received in a respective alignment notch 267 of a corresponding keyway pin 260. A tapered bar 304 extends perpendicular from the shaft portions 302 and is connected thereto by bridging members 306. The cylinder body 242 includes a plurality of vertical slots 251, each configured to receive a corresponding shaft portion 302 with a keyway pin 260 engaged therewith. Each vertical slot 251 terminates in a horizontal slot 253 configured to receive a corresponding bridging member 306 and thereby guide radial movement of the re-combinating sidebar 300. A horizontal opening 250 extends through the side of the cylinder body 242 and is in communication with the vertical slots 251 such that the tapered bar 304 may extend radially outwardly from the cylinder plug 240. A plurality of springs 308 or the like are positioned between the cylinder body 242 and the tapered bar 304 such that the re-combinating sidebar 300 is biased radially outward.

Figure 16:
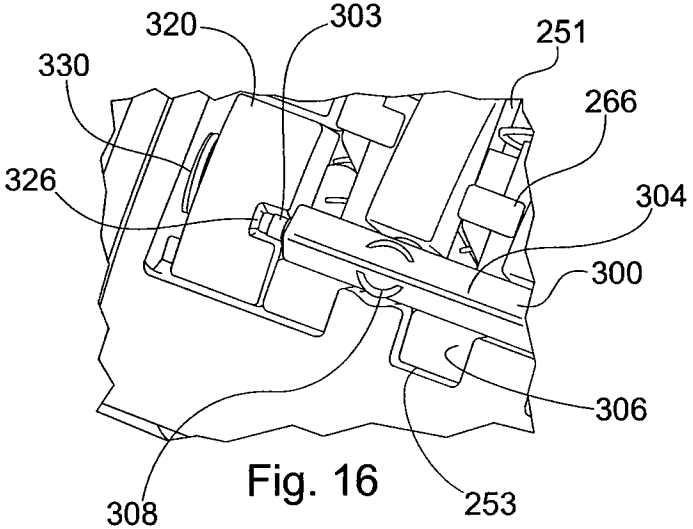
FIG. 16 is an enlarged isometric view illustrating the re-combinating sidebar engaging the reset actuator when a user key is inserted in the keyway.

Referring to FIGS. 13-15, during normal operation, the re-combinating sidebar 300 is maintained in a radially inward position by engagement of the tapered bar 304 with the inside surface 224 of the housing 220. In the radially inward position, the gear teeth 273 engage the keyway pin teeth 263. Similar to the previous embodiment, a reset actuator 320 is engagable between the cylinder body 242 and the re-combinating sidebar 300 to maintain the re-combinating sidebar 300 in this radially inward, normal operation mode. The reset actuator 320 includes an actuator body 322 with a reset contact 324 defined thereon. A front face of the actuator body 322 includes a bore 326. The bore 326 is configured to receive a post 303 extending rearward from rearward most bridge portion 306*a* (see FIG. 16). In the normal operating mode, the post 303 is received in bore 326, as shown in FIG. 16, and thereby maintains the re-combinating sidebar 300 in the radially inward, normal operating position. A spring 330 or the like engages the rear side of the actuator body 322 and biases the reset actuator 320 toward the re-combinating sidebar 300, thereby maintaining the post 303 engaged within the bore 326 unless a proper reset key 150' is positioned in the keyway 239. The present embodiment utilizes a reset key 150' as described with respect FIGS. 7 and 8 above.

Having generally described the components of the lock cylinder assembly 210, normal operation and reprogramming thereof will now be described with reference to FIGS. 13-19. The lock cylinder assembly 210 is shown in FIG. 13 in an originally assembled configuration with each keyway pin 260 engaged with a respective gear 270 such that a key biting is defined for each keyway pin 260. In the locked position shown, the springs 278 bias the keyway pins 260 to a lower position, and thereby rotate the gears 270 such that the sidebar rail portion 282 is misaligned with the gear notches 274. As such, the sidebar tapered portion 284 engages the tapered groove 225, thereby preventing rotation of the cylinder plug 240 relative to the housing 220.

To operate the lock cylinder assembly 210 in normal operation, an appropriate user key 150 is inserted into the keyway 239 as shown in FIG. 14. As the user key 150 is inserted, the teeth and notches 152 engage the respective keyway pins 260, raising the keyway pins 260 and thereby rotating the gears 270 to an unlocked position wherein the notches 274 are all aligned with the sidebar rail portion 282.

The user then turns the user key 150 as illustrated in FIG. 15. Since the sidebar rail portion 282 is aligned with the notches 274, the sidebar tapered portion 284 rides up the tapered groove 225 as the sidebar rail portion 282 is received in the notches 274. The plug cylinder 240 is freely rotated relative to the housing 220. As explained above, even if the plug cylinder 240 is rotated such that the tapered bar 304 is circumferentially aligned with the tapered groove 225, the reset actuator 320 prevents the sidebar 300 from moving radially outward as shown in FIG. 16. As such, the keyway pins 260 are maintained in engagement with the gears 270.

Figure 17:
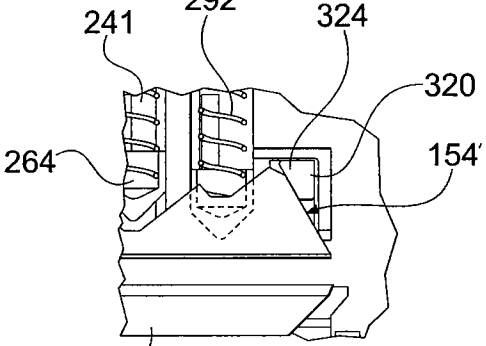
FIG. 17 is a partial cross-sectional view illustrating the engagement of a reset key with the reset actuator.
Figure 19:
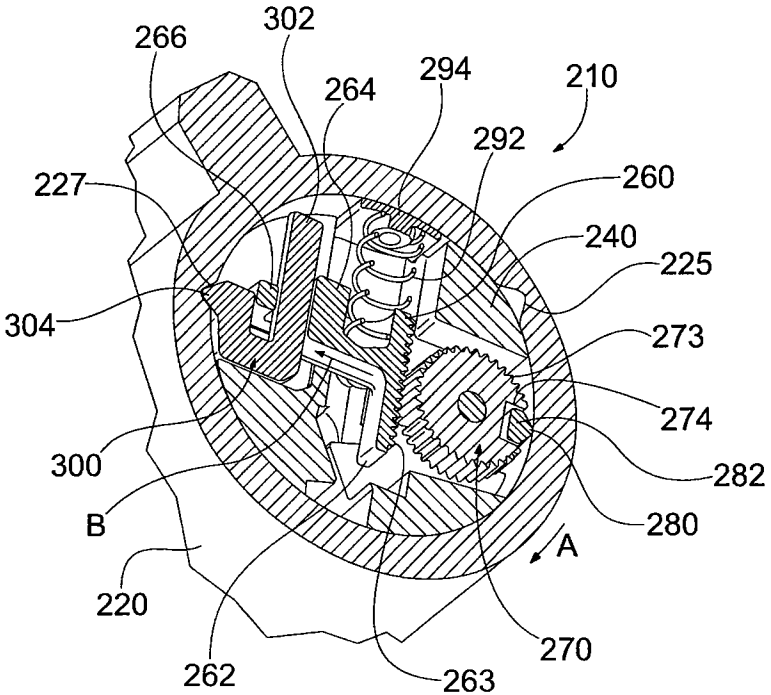
FIG. 19 is a cross-sectional view similar to FIG. 13 with the reset key inserted into the lock cylinder assembly and the cylinder plug rotated to a reset position.

If a user desires to reprogram the lock cylinder assembly 210 without disassembling the lock cylinder assembly, the user may insert a proper reset key 150' as shown in FIG. 17. As explained below, reprogramming of the lock cylinder assembly 210 requires rotation of the cylinder plug 240. As such, inserting an improper key, i.e. one not having the proper biting, will not allow reprogramming because the improper key will not properly move the keyway pins 260 and the cylinder plug 240 will not be rotatable.

Figure 18:
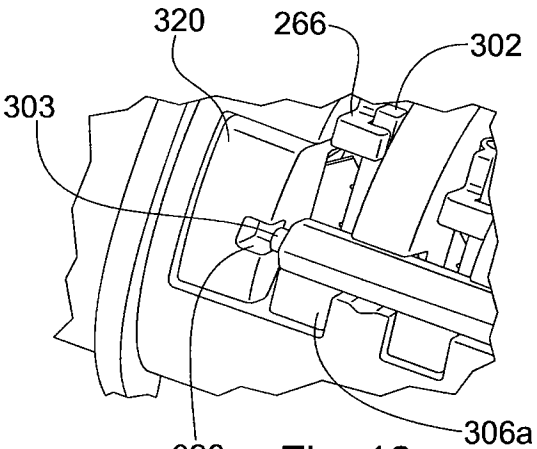
FIG. 18 is an enlarged isometric view similar to FIG. 16 illustrating the re-combinating sidebar disengaged from the reset actuator when a reset key is inserted in the keyway.

To reprogram the lock cylinder assembly 210, the user inserts a current reset key 150A' into the keyway 239. By "current", it is meant that the reset key 150A' has a tooth and notch 152 configuration which matches the currently programmed configuration of the lock cylinder assembly 210. When the current reset key 150A' is inserted, the key 150A' engages each of the keyway pins 260 and moves the respective gears 270 to the unlock position similar to as described above with respect to the user key 150. The current reset key 150A' is then rotated in the direction of arrow A in FIG. 19. While clockwise rotation is illustrated in the present embodiment, the invention is not limited to such. As with normal operation, the sidebar tapered portion 284 rides up the tapered groove 225 as the sidebar rail portion 282 is received in the notches 274. Rotation of the key and cylinder plug 240 is continued until the tapered bar 304 is aligned with the tapered groove 227 in the housing 220. As illustrated in FIGS. 17 and 18, and similar to the above embodiment, the reset key 150A' contacts the reset actuator 320 and pushes it against the force of spring 330, thereby disengaging the post 303 engaged within the bore 326.

With the post 303 disengaged, the springs 308 bias the re-combinating sidebar 300 radially outward as the tapered bar 304 enters the tapered groove 225. As the re-combinating sidebar 300 moves radially outward, each keyway pin 260 is also moved in the direction of arrow B in FIG. 19 such that the teeth 263 disengage from the respective gear teeth 273. The gears 270 stay aligned with the sidebar 280 based on the engagement of the rail portion 282 in each of the notches 274.

The current reset key 150A' is removed whereby the top springs 292 bias the keyway pins 260 to a lower most position. To complete the reprogramming, it is necessary for the user to insert a new reset key 150B'. By "new", it is meant that the reset key 150B' has a tooth and notch 152 configuration which matches the configuration of the intended or new user key to which the lock cylinder assembly 210 is to be programmed. When the new reset key 150B' is inserted, each of the keyway pins 260 is moved to a desired position relative to a respective gear 270.

The new reset key 150B' is rotated in the reverse direction which causes the tapered bar 304 to ride up the tapered groove 225 and move the re-combinating sidebar 300 radially inward. As the re-combinating sidebar 300 moves radially inward, the keyway pins 260 move inwardly toward the gears 270, thereby engaging the teeth 263 with the gear teeth 273 based on new reset key 150B' tooth and notch 152 configuration.

Once the cylinder plug 240 is returned to the home position, the key 150B' is removed. Upon removal, the reset actuator 320 engages the post 303 whereby the re-combinating sidebar 300 is maintained in the radially inward position. The reprogrammed lock cylinder assembly 210 may thereafter be operated in a normal manner with user keys 350 having the new configuration.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A programmable lock cylinder assembly comprising:
a lock housing having a body defining a tubular opening;
a cylinder plug having a body mounted for rotation within the tubular opening, the cylinder plug including a keyway extending therein;
at least one locking member in the cylinder plug and moveable between a locked position wherein the cylinder plug is rotationally locked relative to the housing and an unlocked position wherein the cylinder plug is rotational relative to the housing;
a plurality of pin sets, each pin set including a keyway pin component and a locking pin component and positioned in the cylinder plug such that a portion of each keyway pin component extends across the keyway, each keyway pin component selectively engagable with a respective locking pin component;
a re-combinating member engaged with one of the components of each pin set and moveable between a first position wherein the keyway pin components are engaged with the locking pin components and a second position wherein the keyway pin components are disengaged from the locking pin components; and
a reset actuator positioned within the cylinder plug with a portion aligned with the keyway, the reset actuator moveable between an engaged position wherein the re-combinating member position is locked relative to the cylinder plug and a non-engaged position wherein the re-combinating member position is moveable relative to the cylinder plug,
wherein each keyway pin component includes at least one tooth configured to engage a toothed surface of the respective locking pin component when the re-combinating member is in the engaged position,
wherein the each locking pin component is a gear and the toothed surface is an arcuate surface.

2. The programmable lock cylinder assembly according to claim 1 wherein the reset actuator defines at least one bore configured to receive and retain a post extending from the re-combinating member when the reset actuator is in the engaged position.

3. The programmable lock cylinder assembly according to claim 2 wherein the reset actuator is biased to the engaged position.

4. The programmable lock cylinder assembly according to claim 1 wherein the toothed surface is a linear surface.

5. The programmable lock cylinder assembly according to claim 1 wherein the re-combinating member is engaged with each locking pin component such that the locking pin components move with, and thereby away from engagement with the keyway pin components, when the re-combinating member moves to the non-engaged position.

6. The programmable lock cylinder assembly according to claim 1 wherein each keyway pin component is biased radially to a lowermost position relative to the keyway.

7. The programmable lock cylinder assembly according to claim 1 wherein the at least one locking member includes a sidebar biased radially outward and received in a groove along the lock housing in the locked position.

8. A programmable lock cylinder assembly comprising:

a lock housing having a body defining a tubular opening;

a cylinder plug having a body mounted for rotation within the tubular opening, the cylinder plug including a keyway extending therein;

at least one locking member in the cylinder plug and moveable between a locked position wherein the cylinder plug is rotationally locked relative to the housing and an unlocked position wherein the cylinder plug is rotational relative to the housing;

a plurality of pin sets, each pin set including a keyway pin component and a locking pin component and positioned in the cylinder plug such that a portion of each keyway pin component extends across the keyway, each keyway pin component selectively engagable with a respective locking pin component;

a re-combinating member engaged with one of the components of each pin set and moveable between a first position wherein the keyway pin components are engaged with the locking pin components and a second position wherein the keyway pin components are disengaged from the locking pin components; and a reset actuator positioned within the cylinder plug with a portion aligned with the keyway, the reset actuator moveable between an engaged position wherein the re-combinating member position is locked relative to the cylinder plug and a non-engaged position wherein the re-combinating member position is moveable relative to the cylinder plug, wherein the re-combinating member is engaged with each keyway pin component such that the keyway pin components move with, and thereby away from engagement with the locking pin components, when the re-combinating member moves to the non-engaged position.

9. A programmable lock cylinder assembly comprising:

a lock housing having a body defining a tubular opening;

a cylinder plug having a body mounted for rotation within the tubular opening, the cylinder plug including a keyway extending therein;

at least one locking member in the cylinder plug and moveable between a locked position wherein the cylinder plug is rotationally locked relative to the housing and an unlocked position wherein the cylinder plug is rotational relative to the housing;

a plurality of pin sets, each pin set including a keyway pin component and a locking pin component and positioned in the cylinder plug such that a portion of each keyway pin component extends across the keyway, each keyway pin component selectively engagable with a respective locking pin component;

a re-combinating member engaged with one of the components of each pin set and moveable between a first position wherein the keyway pin components are engaged with the locking pin components and a second position wherein the keyway pin components are disengaged from the locking pin components; and a reset actuator positioned within the cylinder plug with a portion aligned with the keyway, the reset actuator moveable between an engaged position wherein the re-combinating member position is locked relative to the cylinder plug and a non-engaged position wherein the re-combinating member position is moveable relative to the cylinder plug, wherein the at least one locking member includes a plurality of top pins, each top pin radially supported by a respective locking pin component and biased to extend across a shear line between the cylinder plug and the lock housing in the locked position.

10. The programmable lock cylinder assembly according to claim 9 wherein each locking pin component includes a head configured to support the respective top pin, the head supported by the lock cylinder radially spaced from the shear line in the locked position and extended radially outward to a position adjacent the sheer line in the unlocked position.

11. The programmable lock cylinder assembly according to claim 9 wherein each locking pin component defines a notch configured to receive a portion of the respective keyway pin component and thereby guide relative movement therebetween.

12. A programmable lock cylinder assembly comprising:

a lock housing having a body defining a tubular opening;

a cylinder plug having a body mounted for rotation within the tubular opening, the cylinder plug including a keyway extending therein;

at least one locking member in the cylinder plug and moveable between a locked position wherein the cylinder plug is rotationally locked relative to the housing and an unlocked position wherein the cylinder plug is rotational relative to the housing;

a plurality of pin sets, each pin set including a keyway pin component and a locking pin component and positioned in the cylinder plug such that a portion of each keyway pin component extends across the keyway, each keyway pin component selectively engagable with a respective locking pin component;

a re-combinating member engaged with one of the components of each pin set and moveable between a first position wherein the keyway pin components are engaged with the locking pin components and a second position wherein the keyway pin components are disengaged from the locking pin components; and a reset actuator positioned within the cylinder plug with a portion aligned with the keyway, the reset actuator moveable between an engaged position wherein the re-combinating member position is locked relative to the cylinder plug and a non-engaged position wherein the re-combinating member position is moveable relative to the cylinder plug, wherein each locking pin component includes a toothed gear defining a locking sidebar notch configured to receive a sidebar in the unlocked position.

13. The programmable lock cylinder assembly according to claim 12 wherein each toothed gear is independently rotatably supported relative to the cylinder plug.

* * * * *